US011150065B2

(12) United States Patent
Smith et al.

(10) Patent No.: US 11,150,065 B2
(45) Date of Patent: Oct. 19, 2021

(54) THERMAL ENERGY ABSORBING STRUCTURES

(71) Applicant: Raytheon Company, Waltham, MA (US)

(72) Inventors: David R Smith, Tucson, AZ (US); Thomas M. Deppert, Gilbert, AZ (US)

(73) Assignee: Raytheon Company, Waltham, MA (US)

( * ) Notice: Subject to any disclaimer, the term of this patent is extended or adjusted under 35 U.S.C. 154(b) by 366 days.

(21) Appl. No.: 15/342,011

(22) Filed: Nov. 2, 2016

(65) Prior Publication Data

US 2018/0120071 A1 May 3, 2018

(51) Int. Cl.

| | |
|---|---|
| ***F25D 19/00*** | (2006.01) |
| ***F42B 15/34*** | (2006.01) |
| ***F42B 39/18*** | (2006.01) |
| ***F25D 5/00*** | (2006.01) |

(52) U.S. Cl.
CPC ..... *F42B 15/34* (2013.01); *F25D 5/00* (2013.01); *F25D 19/00* (2013.01); *F42B 39/18* (2013.01)

(58) Field of Classification Search
CPC ..... F42B 15/34; F42B 39/18; F25D 5/00
See application file for complete search history.

(56) References Cited

U.S. PATENT DOCUMENTS 1,950,905 A * 3/1934 Rubin ..... F25D 5/00 62/441
3,267,857 A 8/1966 Lindberg, Jr.
3,395,035 A 7/1968 Strauss
3,682,100 A 8/1972 Lindberg, Jr.
5,212,944 A * 5/1993 Martin ..... C08K 3/36 239/DIG. 19
6,004,662 A 12/1999 Buckley
6,558,568 B1 * 5/2003 Hayes ..... A23G 7/02 165/10

(Continued)

FOREIGN PATENT DOCUMENTS

JP S5620975 A 2/1981
JP H06174350 A 6/1994

OTHER PUBLICATIONS

Foreign Communication from Related Counterpart Application; PCT Patent Application No. PCT/US20171044125; International Search Report and Written Opinion of the International Searching Authority dated Oct. 23, 2017; 15 pages.

*Primary Examiner* — Elizabeth J Martin
*Assistant Examiner* — Nael N Babaa

(57) ABSTRACT

Thermally-sensitive hardware is at least partially enclosed within a container in which reactants for a solid-solid endothermic chemical reaction are disposed, surrounding at least a portion of the thermally-sensitive hardware. The reactants or a structure including the reactants are positioned between the thermally-sensitive hardware and a heat source, such as an external surface of a missile traveling through atmospheric gases at extremely high speed and experiencing extreme frictional heating. The reactants absorb heat during the solid-solid endothermic reaction to thermally protect the thermally-sensitive hardware. The reactants are preferably selected to absorb heat of at least 5 kilo-Joules per gram (kJ/g) during the solid-solid endothermic chemical reaction.

23 Claims, 1 Drawing Sheet

(56) References Cited

U.S. PATENT DOCUMENTS

| | | | | |
|---|---|---|---|---|
| 2009/0270260 | A1* | 10/2009 | Tanaka | C04B 35/645<br>505/150 |
| 2011/0048374 | A1* | 3/2011 | McAlister | F02M 57/06<br>123/436 |
| 2015/0361362 | A1* | 12/2015 | Daggupati | B01J 29/40<br>252/373 |

* cited by examiner

THERMAL ENERGY ABSORBING STRUCTURES

TECHNICAL FIELD

The present disclosure is directed in general to thermal protection of critical electronics hardware undergoing extreme heat excursions, and, more particularly, to protection of critical electronics hardware within vehicles traveling at extremely high speeds.

BACKGROUND OF THE DISCLOSURE

Aeronautical vehicles such as missiles traveling at extremely high speeds—for example, speeds at or in excess of Mach 5—generate frictional heat at the exterior surfaces due to passage through the atmospheric gases. That heat will dissipate along any temperature gradient including toward the missile interior. Conventional insulation and thermal dissipation mechanisms may be insufficient to protect thermally-sensitive equipment within the missile from the temperature excursions generated by travel at such extremely high speeds.

SUMMARY OF THE DISCLOSURE

Thermally-sensitive hardware such as electronics, energetic devices or optical elements is at least partially enclosed within a container within which reactants for a solid-solid endothermic chemical reaction are disposed, surrounding at least a portion of the electronics hardware. The reactants are preferably selected to absorb heat from a heat source external to the container, and are preferably positioned between the heat source and the thermally-sensitive hardware. The heat source may be an exterior surface of a missile within which the container is mounted, where the missile's exterior surface experiences frictional heating due to travel through atmospheric gases at extremely high speeds at or in excess of Mach 5. In alternative embodiments, a structure between the thermally-sensitive hardware and a heat source includes the reactants, such as a surface coating on the missile configured for ablation of the chemical reaction products. The reactants are preferably selected to absorb heat of at least 5 kilo-Joules per gram (kJ/g) during the solid-solid endothermic chemical reaction, and preferably include at least a first reactant selected from the group of silicon dioxide ($SiO_2$), aluminum oxide ($Al_2O_3$) and titanium oxide ($TiO_2$) and a second reactant selected from the group of a carbon-containing polymer and a boron-containing polymer. Such selected reactants produce, via the endothermic solid-solid chemical reaction, one of silicon carbide (SiC), aluminum carbide ($Al_4C_3$), and titanium boride ($TiB_2$). Insulation materials and heat dissipation structures may also be used, together with the selected reactants.

Although specific advantages have been enumerated above, various embodiments may include some, none, or all of the enumerated advantages. Additionally, other technical advantages may become readily apparent to one of ordinary skill in the art after review of the following figures and description.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Figure 1:
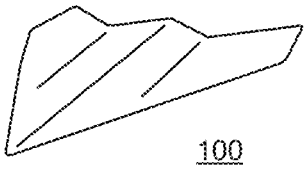
FIGS. 1 and 1A are pictorial illustrations of, respectively, a hypersonic missile within which a thermally-sensitive hardware module for which thermal energy absorbing structures is implemented in accordance with embodiments of the present disclosure.

It should be understood at the outset that, although exemplary embodiments are illustrated in the figures and described below, the principles of the present disclosure may be implemented using any number of techniques, whether currently known or not. The present disclosure should in no way be limited to the exemplary implementations and techniques illustrated in the drawings and described below. Additionally, unless otherwise specifically noted, articles depicted in the drawings are not necessarily drawn to scale.

Desire for increased missile speed requires new and innovative forms of thermal management. Frictional heat that may adversely affect thermally-sensitive hardware (electronics, energetic devices such as initiators and gas generators, optical elements) must be controlled. Possible approaches to controlling frictional heat via engineering design include insulation, dissipation, absorption, or combinations of each.

Hypersonic missiles traveling at speeds in excess of Mach 5 generate frictional heat at levels that constitute a threat to reliable operation of thermally-sensitive hardware within the missile, such as guidance and control electronics. (As used herein, "thermally-sensitive hardware" refers to at least electronics, energetic devices, and optical elements, as well as other hardware, and to such hardware that cannot operate reliably in the presence of frictional heat generated due to travel at speeds in excess of about Mach 2.5 or Mach 3). Heating issues can be mitigated using energy absorbing solid/solid chemical reactions by manufacturing structures using the energy-absorbing reactants. In this disclosure, solid/solid chemical reactions are suggested for the absorption of heat in applications that produce high temperature excursions during operation. These endothermic solid/solid reactions employ inert reactants and produce inert products while consuming heat. In contrast, alternative approaches to protect electronic hardware during heating events (a) exclude the heat from reaching the electronics using insulating materials (insulation) and/or spacing from regions in which the heat is generated (design), (b) dump excess heat to the environment (dissipation), (c) employ phase change materials (absorption), or (d) some combination of insulation/design, dissipation, and absorption. However, insulating materials have relatively limited heat blocking capabilities, generally insufficient to adequately protect electronics at the heating levels contemplated. Effective or sufficient heat transfer by dissipation to the environment is not always possible, since a heat sink (relatively "cold" thermal region) is required and since heat dissipation may not proceed quickly enough. Phase change (e.g., from solid to liquid) absorption necessitates protection of the electronics from the resulting liquid, and generally has relatively low thermal absorption capacities requiring large quantities (and the associated weight) to adequately protect electronics at the heating levels contemplated.

The problem of thermal management for electronic hardware during extreme heating events is addressed in this disclosure at least in part by creating structures that absorb heat through solid-solid endothermic chemical reactions to provide cooling of critical hardware. Reactions involving two solids intimately mixed together can be employed to absorb heat due to an endothermic reaction between the materials. Theoretical heat absorption of greater than 5-10 kilo Joules per gram (kJ/g) are possible with this approach.

Figure 1A:
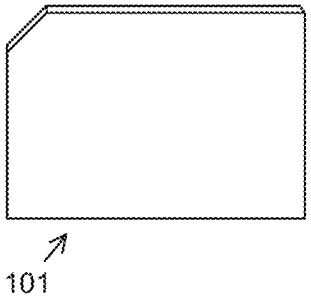

FIGS. 1 and 1A are pictorial illustrations of, respectively, a hypersonic missile within which a thermally-sensitive hardware module for which thermal energy absorbing structures is implemented in accordance with embodiments of the present disclosure. Those skilled in the art will recognize that, for simplicity and clarity, some features and components are not explicitly shown, including those illustrated in connection with later figures. Such features, including those illustrated in later figures, will be understood to be equally applicable to the systems of FIGS. 1 and 1A.

FIG. 1 is a pictorial illustration of a hypersonic missile within which thermal energy absorbing structures are implemented in accordance with embodiments of the present disclosure. Hypersonic missile 100 is preferably designed to travel at speeds up to and in excess of Mach 5, generating very high levels of frictional heat. Mounted within the hypersonic missile 100 is thermally-sensitive hardware 101 schematically depicted in FIG. 1A. Those skilled in the art understand that thermally-sensitive hardware 101 may be in the form of a circuit board on which electronic components are mounted with conductive traces interconnecting connectors or pins of various components, implemented in ruggedized manner and/or in a manner tolerating high temperatures. The thermally-sensitive hardware 101 may include multiple different hardware packages, which separately or collectively comprise or control flight actuators, power controllers, electrical power switching and distribution, optical systems, communications, guidance, and the like. While designed to operate at relatively high temperatures (above normal electronics operating temperature ranges), the frictional heat generated by the hypersonic missile 100 traveling at top speed is likely to cause heating to temperatures exceeding the operating temperature range within which the thermally-sensitive hardware 101 can reliably operate.

The present disclosure employs energy-absorbing solid/solid reactions for cooling, in the construction of structural parts or coatings on structural parts. These structures then become an integral part of the hardware that absorbs thermal energy, with the structures constructed from the reactants used for the energy absorption. The thermal energy absorption utilizes endothermic chemical reactions to remove heat by absorbing the heat, and in particular utilizes solid/solid endothermic chemical reactions to absorb heat. Exemplary reactions are listed in TABLE 1 below:

TABLE 1

| Reaction | Endothermic capacity (kJ/g) |
|---|---|
| $SiO_2 + 3C \rightarrow SiC + 2CO$ | 6 |
| $2Al_2O_3 + 9C \rightarrow Al_4C_3 + 6CO$ | 12 |
| $TiO_2 + 2B \rightarrow TiB_2 + O_2$ | 11 |

As apparent from TABLE 1, the reactants for the solid-solid endothermic reaction are preferably selected to absorb heat of at least 5 kilo-Joules per gram (kJ/g), and more preferably of at least 10 kJ/g, during the solid-solid endothermic chemical reaction.

Energy absorption from phase change typically involves energy from intermolecular forces, and therefore often involves phase change from solid to either liquid or gas. Although generally reversible, these reactions only absorb energy on the order of tenths or a kilo-Joule per gram or less (i.e., <1.0 kJ/g). By contrast, endothermic chemical changes involve energy from breaking or making chemical bonds and are primarily solid to solid reactions. While not reversible, these reactions absorb up to two orders of magnitude more energy (≥5-10 kJ/g).

Figure 2A:
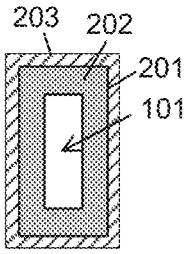
FIGS. 2A, 2B and 2C diagrammatically depict different implementations of thermal energy absorbing structures in accordance with embodiments of the present disclosure.
Figure 2B:
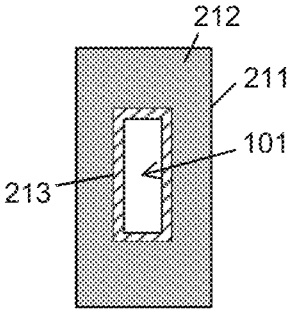
Figure 2C:
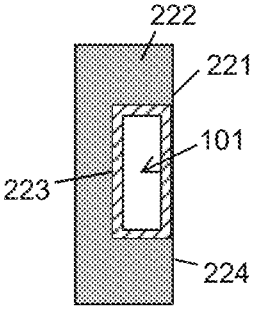

FIGS. 2A, 2B and 2C diagrammatically depict different implementations of thermal energy absorbing structures in accordance with embodiments of the present disclosure. In FIG. 2A, the thermally-sensitive hardware 101 is held within a container or housing 201. The thermally-sensitive hardware 101 may be mounted or secured in position with container 201 by various mounting mechanisms (not shown) such as standoffs projecting from the container walls, to which the thermally-sensitive hardware 101 is secured by screws or the like, etc. Alternatively, thermally-sensitive hardware 101 may be secured in position within container 201 by being held in place by the reactants 202 within the container 201.

In one embodiment, the reactants 202 include a solid such as silicon dioxide ($SIO_2$) or aluminum oxide ($Al_2O_3$) in particulate form, together with a carbon-containing polymer. In another embodiment, the reactants 202 include a solid such as titanium dioxide ($TiO_2$), together with a boron-containing polymer. In any of those embodiments, the polymer may be impregnated with the particulate solid reactant(s), or the particulate solid reactant(s) may simply have polymer materials interspersed therein. The particulate-impregnated polymer may be injected into spaces surrounding the thermally-sensitive hardware 101 to be protected, or the polymer may be injected into particulate-filled spaces.

In the example shown in FIG. 2A, the container 201 also includes a layer of insulating material 203 surrounding the container 201. Alternatively, as in FIGS. 2B and 2C, insulating material may be formed around the thermally-sensitive hardware 101 to be thermally protected, with the reactants for heat absorption by solid-solid endothermic chemical reaction surrounding the insulated thermally-sensitive hardware 101. Additional heat insulation or dissipation mechanisms may also be employed in conjunction with the arrangements shown in FIGS. 2A-2C.

In the embodiment of FIG. 2B, the thermally-sensitive hardware 101 is surrounded by an insulating layer 213, both of which are disposed within a container 211. The insulated thermally-sensitive hardware 101 may be secured in position within container 211 in the same manner described above for container 201. The inside of the container 211, between the walls of the container 211 and the insulating layer 213 surrounding thermally-sensitive hardware 101, is filled with reactants 212, which are preferably a solid such as $SiO_2$, $Al_2O_3$, or $TiO_2$ and a carbon- or boron-containing polymer.

In the embodiment of FIG. 2C, the thermally-sensitive hardware 101 is surrounded by an insulating layer 223, both of which are disposed within a container 221. The insulated thermally-sensitive hardware 101 may be secured directly to a sidewall of the container 221, for ease of mounting. Since the source of heat is directional (originating from an exterior surface of missile 100), the container 221 may be mounted within missile 100 with the wall 224 of container 221 on which the insulated thermally-sensitive hardware 101 is mounted positioned further from the exterior surfaces of missile 100 than remaining surfaces of container 221. The reactants 222 surrounding all but one side of the insulated thermally-sensitive hardware 101 will provide sufficient thermal protection in these embodiments.

In operation, frictional heat generated by the missile's speed can cause the reactants to reach a reaction temperature, such as a temperature at which the carbon- or boron-containing polymer breaks down (e.g., melts) or a temperature that must be reached for the endothermic reaction to initiate. Once the reactants reach the reaction temperature, the solid-solid chemical reaction occurs, absorbing heat at the respective endothermic capacity and protecting the thermally-sensitive hardware 101 from excess heat. The gaseous products—that is, carbon monoxide (CO) or oxygen ($O_2$) for the examples above—outgas from the particulate solid products of silicon carbide (SiC), aluminum carbide ($Al_4C_3$) or titanium boride ($TiB_2$) but should not adversely affect the thermally-sensitive hardware. In some instances, the gaseous product may simply be retained within the container 201, 211, while in other embodiments gas in excess of a particular pressure may be vented by a release valve (not shown).

While the reactants are depicted in FIGS. 2A and 2B as filling a container housing the thermally-sensitive hardware 101, alternative implementations are also contemplated. For example, the reactants may be formed as a coating on exterior surfaces of missile 100, configured for ablation of the solid product as the reaction progresses.

Modifications, additions, or omissions may be made to the systems, apparatuses, and methods described herein without departing from the scope of the disclosure. For example, the components of the systems and apparatuses may be integrated or separated. Moreover, the operations of the systems and apparatuses disclosed herein may be performed by more, fewer, or other components and the methods described may include more, fewer, or other steps. Additionally, steps may be performed in any suitable order. As used in this document, "each" refers to each member of a set or each member of a subset of a set.

The description in the present application should not be read as implying that any particular element, step, or function is an essential or critical element which must be included in the claim scope: the scope of patented subject matter is defined only by the allowed claims. Moreover, none of these claims are intended to invoke 35 USC § 112(f) with respect to any of the appended claims or claim elements unless the exact words "means for" or "step for" are explicitly used in the particular claim, followed by a participle phrase identifying a function. Use of terms such as (but not limited to) "mechanism," "module," "device," "unit," "component," "element," "member," "apparatus," "machine," "system," "processor," or "controller" within a claim is understood and intended to refer to structures known to those skilled in the relevant art, as further modified or enhanced by the features of the claims themselves, and is not intended to invoke 35 U.S.C. § 112(f).

What is claimed is:

1. A system, comprising:

at least one thermally-sensitive component;

a container enclosing at least a portion of the at least one thermally-sensitive component;

an insulation layer at least partially surrounding the thermally-sensitive component; and an oxide reactant and a polymer reactant for a solid-solid endothermic chemical reaction disposed within the container and surrounding at least a portion of the at least one thermally-sensitive component;

wherein the solid-solid endothermic chemical reaction comprises an endothermic chemical reaction between the oxide reactant and the polymer reactant that is initiated when the polymer reactant reaches a breakdown temperature; and wherein the oxide reactant and the polymer reactant fill a space between the insulation layer and the container.

2. The system according to claim 1, wherein the oxide and polymer reactants are selected to absorb heat from a heat source external to the container.

3. The system according to claim 2, wherein the oxide and polymer reactants are positioned between the heat source and the at least one thermally-sensitive component.

4. The system according to claim 3, wherein the heat source is an exterior surface of a vehicle within which the container is mounted, and wherein the exterior surface experiences frictional heating due to travel through atmospheric gases.

5. The system according to claim 1, wherein the oxide and polymer reactants are selected to absorb heat of at least 5 kilo-Joules per gram (kJ/g) during the solid-solid endothermic chemical reaction.

6. The system according to claim 1, wherein one of:

the oxide reactant comprises silicon dioxide and the polymer reactant comprises a carbon-containing polymer;

the oxide reactant comprises aluminum oxide and the polymer reactant comprises the carbon-containing polymer; or the oxide reactant comprises titanium oxide and the polymer reactant comprises a boron-containing polymer.

7. The system according to claim 1, wherein the container is configured to retain a gaseous product of the endothermic chemical reaction within the container.

8. A system, comprising:

at least one thermally-sensitive component; and a structure between at least one surface of the at least one thermally-sensitive component and a heat source, the structure including:

a container enclosing at least a portion of the at least one thermally-sensitive component;

an insulation layer at least partially surrounding the thermally-sensitive component; and an oxide reactant and a polymer reactant for a solid-solid endothermic chemical reaction disposed within the container and surrounding at least a portion of the at least one thermally-sensitive component;

wherein the solid-solid endothermic chemical reaction comprises an endothermic chemical reaction between the oxide reactant and the polymer reactant that is initiated when the polymer reactant reaches a breakdown temperature; and wherein the oxide reactant and the polymer reactant fill a space between the insulation layer and the container.

9. The system according to claim 8, wherein the solid-solid endothermic chemical reaction produces one of: silicon carbide (SiC), aluminum carbide ($Al_4C_3$), or titanium boride ($TiB_2$).

10. The system according to claim 8, wherein one of:

the oxide reactant comprises silicon dioxide and the polymer reactant comprises a carbon-containing polymer;

the oxide reactant comprises aluminum oxide and the polymer reactant comprises the carbon-containing polymer; or the oxide reactant comprises titanium oxide and the polymer reactant comprises a boron-containing polymer.

11. The system according to claim 8, wherein the heat source is an exterior surface of a vehicle within which the at least one thermally-sensitive component is mounted, and wherein the exterior surface experiences frictional heating due to travel through atmospheric gases.

12. The system according to claim 8, wherein the container is configured to retain a gaseous product of the endothermic chemical reaction within the container.

13. The system according to claim 8, further comprising a heat dissipation structure associated with the at least one thermally-sensitive component.

14. A method, comprising:

providing a container enclosing at least a portion of at least one thermally-sensitive component;

positioning an insulation layer at least partially surrounding the thermally-sensitive component; and disposing an oxide reactant and a polymer reactant for a solid-solid endothermic chemical reaction within the container and surrounding at least a portion of the at least one thermally-sensitive component;

wherein the solid-solid endothermic chemical reaction comprises an endothermic chemical reaction between the oxide reactant and the polymer reactant that is initiated when the polymer reactant reaches a breakdown temperature; and wherein the oxide reactant and the polymer reactant fill a space between the insulation layer and the container.

15. The method according to claim 14, wherein the oxide and polymer reactants are selected to absorb heat from a heat source external to the container.

16. The method according to claim 15, wherein the oxide and polymer reactants are positioned between the heat source and the at least one thermally-sensitive component.

17. The method according to claim 16, wherein the heat source is an exterior surface of a vehicle within which the container is mounted, and wherein the exterior surface experiences frictional heating due to travel through atmospheric gases.

18. The method according to claim 14, wherein the oxide and polymer reactants are selected to absorb heat of at least 5 kilo-Joules per gram (kJ/g) during the solid-solid endothermic chemical reaction.

19. The method according to claim 14, wherein one of:

the oxide reactant comprises silicon dioxide and the polymer reactant comprises a carbon-containing polymer;

the oxide reactant comprises aluminum oxide and the polymer reactant comprises the carbon-containing polymer; or the oxide reactant comprises titanium oxide and the polymer reactant comprises a boron-containing polymer.

20. The method according to claim 14, further comprising a heat dissipation structure for the container.

21. The system of claim 1, wherein the polymer reactant is impregnated with the oxide reactant in particulate form.

22. The system of claim 1, wherein the polymer reactant is interspersed within the oxide reactant in particulate form.

23. The system of claim 1, wherein the endothermic chemical reaction produces reaction products that include atoms from the oxide reactant and atoms from the polymer reactant.

* * * * *